US006181771B1

(12) United States Patent
Hell et al.

(10) Patent No.: US 6,181,771 B1
(45) Date of Patent: Jan. 30, 2001

(54) X-RAY SOURCE WITH SELECTABLE FOCAL SPOT SIZE

(75) Inventors: Erich Hell; Detlef Mattern, both of Erlandgen; Peter Schardt, Roettenbach, all of (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/306,099

(22) Filed: May 6, 1999

(30) Foreign Application Priority Data

May 6, 1998 (DE) ..... 198 20 243

(51) Int. Cl.[7] ..... H01J 35/30
(52) U.S. Cl. ..... 378/137; 378/136; 378/119
(58) Field of Search ..... 378/119, 125, 378/136, 137; 313/364

(56) References Cited

U.S. PATENT DOCUMENTS 4,748,650 5/1988 Ammann .
5,550,889 8/1996 Gard et al. .
5,812,632 9/1998 Schardt et al. .
5,822,395 * 10/1998 Schardt et al. ..... 378/137
5,883,936 * 3/1999 Hell et al. ..... 378/25

* cited by examiner

*Primary Examiner*—David V. Bruce
*Assistant Examiner*—Pamela R Hobden
(74) *Attorney, Agent, or Firm*—Schiff Hardin & Waite

(57) ABSTRACT

An X-ray source has an emitter for the production of an electron beam and an anode on which the electron beam strikes in an X-ray focal spot, and a magnet system that produces a dipole field and a quadrupole field that is superimposed on this dipole field, for deflecting and focusing the electron beam onto the anode. In addition, an arrangement is provided that operates together with the magnet system for the adjustment of the size of the X-ray focal spot. This arrangement, in order to set a desired size of the X-ray focal spot, adjusts the quadrupole field in so that the X-ray focal spot has a width corresponding to the desired size of the X-ray focal spot, and supplies to the magnet system a wobble signal that influences the dipole field, this wobble signal effecting a periodic displacement of the electron beam in a direction transverse to the extension of the width of the X-ray focal spot. This gives the focal spot an effect length, resulting from the deflection and measured in the direction of the deflection, to achieve a particular ratio of the effective length to the width of the X-ray focal spot.

15 Claims, 2 Drawing Sheets

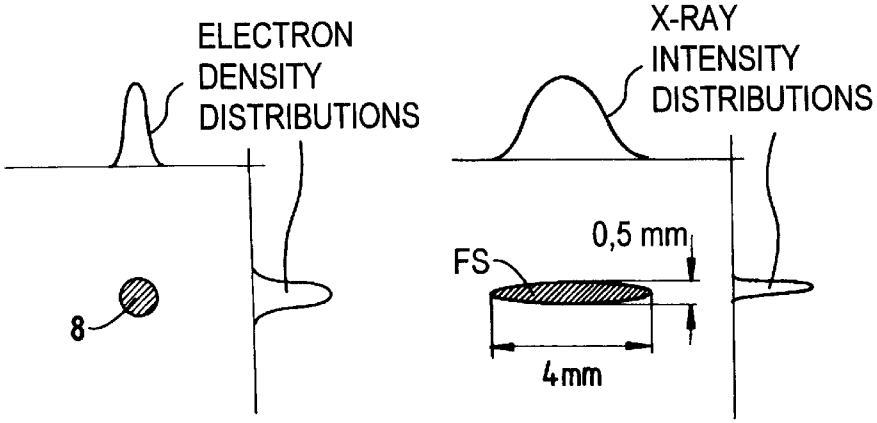
FIG 2a
FIG 2b
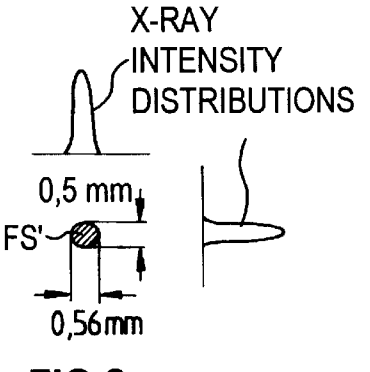
FIG 2c
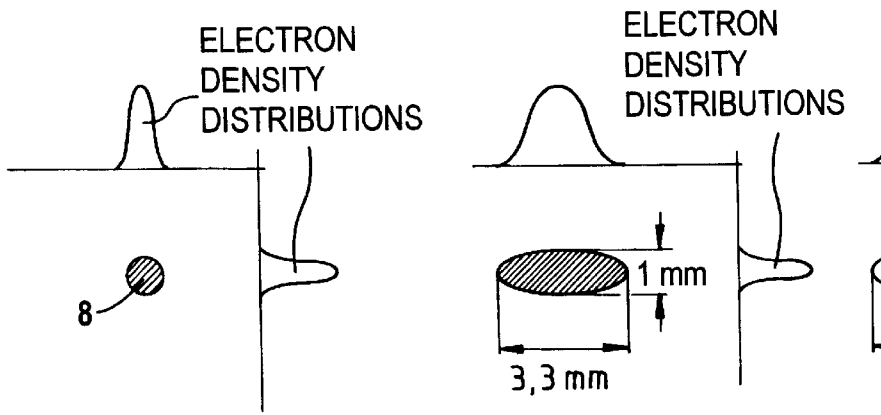
FIG 3a
FIG 3b
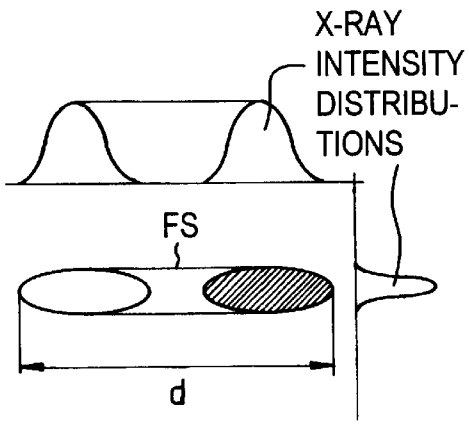
FIG 3c
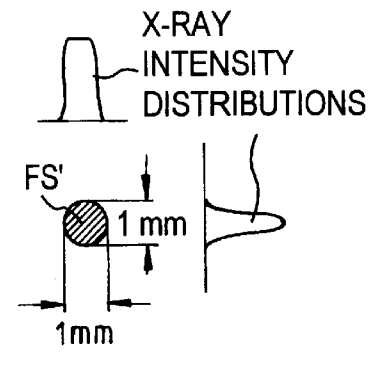
FIG 3d

X-RAY SOURCE WITH SELECTABLE FOCAL SPOT SIZE

BACKGROUND OF THE INVENTION

1. Field of the Invention

The present invention relates to an X-ray source of the type having an electron emitter for the production of an electron beam, an anode on which the electron beam strikes in an X-ray focal spot, and a magnet system that produces a dipole field and a quadrupole field superimposed thereon, for the deflection and focusing of the electron beam onto the anode.

2. Description of the Prior Art

In an X-ray source known from U.S. Pat. No. 5,883,936, fashioned as a rotating bulb source, a magnet system is provided for the deflection and focusing of the electron beam, which emanates from the electron emitter and has an initially circular cross-section. For the production of an X-ray focal spot that is substantially circular, seen opposite the primary direction of propagation of the X-rays emanating from the X-ray focal spot, the quadrupole field is selected such that it modifies the cross-section of the electron beam emitted by the cathode, which initially has a circular cross-section. This modification occurs in such a way that the X-ray focal spot arising at the edge of the anode is elongated in the radial direction due to the anode edge being beveled relative to the primary direction of radiation of the X-ray radiation, relative to the width of the electron beam measured in the tangential direction (length-to-width ratio). This has in turn the result that, as seen in the direction opposite the primary direction of propagation of the X-rays emanating from the X-ray focal spot, the extension of the electron beam in the radial direction corresponds to the extension of the electron beam in the tangential direction. The X-ray focal spot thus has substantially circular shape, with the electron density of the electron beam shortly before the X-ray focal spot being higher than immediately adjacent to the cathode. The Gaussian distribution of the electrons over the cross-section is, however, maintained.

Expensive measures would be necessary in order to enable an adjustment of the size of the X-ray focal spot in such a rotating bulb source, e.g. by means of a switching the largest elongation.

The size of the focal spot could be adjusted in a known manner by means of an adjustable focusing voltage applied to a focus cup that surrounds the electron emitter. An electron emitter with a variable emission surface alternatively could be used that could be constructed as a flat or spiral emitter with several emission surfaces, in particular concentrically arranged, which can be activated individually or together, corresponding to the desired size of the X-ray focal spot. This would have the advantage that the type of drive would be maximally compatible with existing generators. However, disadvantages would include higher manufacturing costs and reduced flexibility. In addition, narrow tolerances in the cathode manufacturing would have to be taken into account.

In addition, it is disadvantageous that neither of the two possibilities offers advantageous conditions for an optimization of the intensity distribution of the X-rays emanating from the X-ray focal spot in the sense of a rectangular curve of the intensity of the X-rays in the radial direction of the X-ray focal spot.

SUMMARY OF THE INVENTION

An object of the present invention is to provide an X-ray source of the type described wherein several different sizes of the X-ray focal spot are possible at low cost According to the invention, this object is achieved in an X-ray source having an electron emitter for the production of an electron beam, having an anode on which the electron beam strikes in an X-ray focal spot, and a magnet system that produces a dipole field and a quadrupole field that is superimposed on this dipole field, for the deflection and focusing of the electron beam, and an arrangement that operates together with the magnet system for the adjustment of the size of the X-ray focal spot. This arrangement, in order to set a desired size of the X-ray focal spot, adjusts the quadrupole field so that the X-ray focal spot has a width corresponding to the desired size of the X-ray focal spot, and supplies to the magnet system a wobble signal that influences the dipole field. This wobble signal effects a periodic displacement of the electron beam in a direction transverse to the extension of the width of the X-ray focal spot over a distance such that the effective length—resulting from the deflection and measured in the direction of the deflection—of the X-ray focal spot is dimensioned to achieve a particular ratio of the effective length to the width of the X-ray focal spot.

Thus in the case of the inventive X-ray source the width of the X-ray focal spot can be adjusted by influencing the quadrupole field, and then, if the cross-section of the electron beam, with respect to its ratio of length to width at the strike point of the electron beam on the anode does not correspond to the desired ratio of length to width of the X-ray focal spot, a dipole field is influenced by a wobble signal so that the electron beam is periodically deflected over such a distance and in such a direction that an X-ray focal spot results with an effective length that produces the desired ratio of length to width of the X-ray focal spot.

In the invention, X-ray focal spots of different size thus can be produced at low cost, since the only additional expenses is that required for components to produce the wobble signal that influences the dipole field.

In a preferred embodiment of the invention, the particular ratio of effective length to width of the X-ray focal spot is adjustable. Arbitrarily small ratios of effective length to width of the X-ray focal spot thus are not possible, since for each width of the X-ray focal spot there is a minimum length, since the cross-section of the electron beam can be influenced by the quadrupole field only in such a way that, together with the width of the cross-section of the electron beam, the length of the cross-section of the electron beam is also modified. As the width of the cross-section of the electron beam increases the length of the cross-section of the electron beam decreases.

Preferably, according to a variant of the invention a particular ratio of effective length to width of the X-ray focal spot is produced so that this ratio, as seen opposite to the primary direction of propagation of the X-ray beam emanating from the anode, is equal to one, since then a high image quality can be achieved, This ratio of effective length to width of the X-ray focal spot of one is of particular importance when the electron emitter produces an electron beam with substantially circular cross-section, since then the X-ray focal spot, as seen opposite the primary direction of propagation of the X-rays, has a circular shape that enables a further improved image quality.

If the X-ray source has a rotating anode with an anode edge that is beveled relative to the primary direction of propagation of the X-rays emanating from the anode, the X-ray focal spot being located on this edge, then according to a variant of the invention the width of the X-ray focal spot extends in the tangential direction of the anode and the resulting length of the X-ray focal spot extends in the radial direction of the anode. Advantageous imaging conditions then exist.

In X-ray sources fashioned as rotating bulb sources, the invention can be realized with a particularly low expense, since then a magnet system that produces a dipole field with a superimposed quadrupole field is present anyway.

According to a variant of the invention, the wobble signal exhibits a chronological curve such that the intensity distribution of the X-ray radiation emanating from the X-ray focal spot has, in the direction of the deflection of the electron beam, a predetermined shape that deviates from a Gaussian distribution and is preferably rectangular. An intensity distribution of the X-rays that is approximately rectangular in the direction of the resulting length of the X-ray focal spot can be realized if the chronological curve of the wobble signal is substantially a sawtooth function.

DESCRIPTION OF THE DRAWINGS

FIG. 2*a* shows a cross-section of the electron beam emanating from the cathode in the X-ray source of FIG. 1 for production of the smallest X-ray focal spot, with curves respectively representing the electron density distribution along the length and width of the cross-section.

FIG. 2*b* shoes a view as seen directly above the anode of the smallest X-ray focal spot on the surface of the anode, with respective curves showing the X-ray intensity distribution along the length and width of the focal spot as seen from directly above the anode.

FIG. 2*c* is a view of the focal spot of FIG. 2*b,* as seen from a direction opposite the primary direction of propagation of the X-rays, with curves respectively representing the X-ray intensity distribution along the length and the width of the focal spot, as seen from the direction opposite the primary direction of propagation of the X-rays.

FIG. 3*a* shows the cross-section of an electron beam emanating from the cathode for production of a larger focal spot, with curves respectively showing the electron density distribution along the length and width.

FIG. 3*b* shows the cross-section of the electron beam of FIG. 3*a* immediately before the electron beam strikes the anode surface, together with curves respectively showing the electron density distribution along the length and width.

FIG. 3*c* is a view of the X-ray focal spot on the surface of the anode, as seen from directly above the anode, showing displacement of the focal spot due to deflection of the electron beam by a wobble signal, together with curves respectively representing the X-ray intensity distribution along the effective length and width of the focal spot.

FIG. 3*d* shows the cross-section of the focal spot, as seen from a direction opposite the primary direction of propagation of the X-rays, on the anode surface, together with curves respectively representing the X-ray intensity distribution, as seen in the direction opposite the primary direction of propagation of the X-rays, along the effective length and width of the focal spot.

DESCRIPTION OF THE PREFERRED EMBODIMENTS

Figure 1:
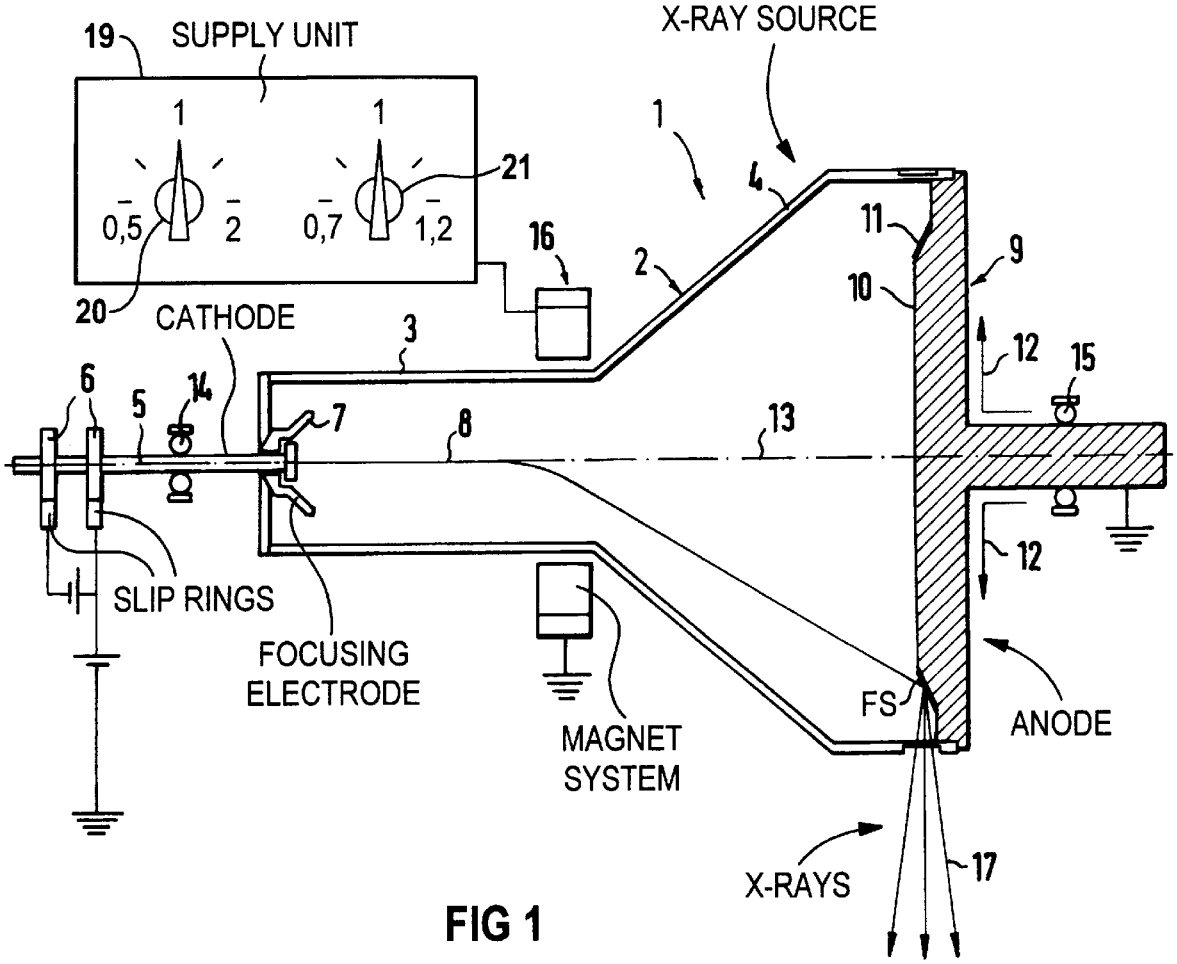
FIG. 1 is a schematic side view, partly in section, of an inventive X-ray source, without the protective housing which normally surrounds the X-ray source and which contains a cooling agent.

FIG. 1 shows an X-ray source 1 according to the invention constructed as a rotating bulb source, having an insulated vacuum housing 2 with a substantially cylindrical region 3 and a segment 4 that is connected thereto and that expands in the shape of a truncated cone.

At the free end of the cylindrical region 3 of the vacuum housing 2, a cathode 5 is arranged as an electron emitter. The cathode 5 is connected via slip rings 6 with a suitable source of heating current, and is applied to a negative potential. A focusing electrode 7 is allocated to the cathode 5, the electrode 7 serving to set the size of the cross-section of the electron beam emitted by the cathodes during operation. In FIG. 1, the electron beam is designated 8.

In the specified embodiment, the cathode 5 and the electrode 7 have a substantially rotationally symmetrical construction causing the electron beam 8 emanating from the cathode 5 and corresponding to the tube current to have a substantially circular cross-section in the vicinity of the cathode 5, as shown in FIGS. 2*a* and 3*a*.

An anode 9 is provided at the end of the vacuum housing 2 opposite the cathode 5. The anode 9 forms the termination of the vacuum housing 2 which is evacuated in the interior. The anode 9 is in the form of an anode dish 10 with a truncated-cone-shaped anode edge 11 that can be deposited with tungsten. The electron beam 8 is incident on the anode edge 11 in an X-ray focal spot designated FS, in order to produce X-rays.

A cooling liquid, indicated by the arrows 12, flows around the anode 9, this liquid filling a protective housing (not shown) that surrounds the vacuum housing 2, and that serves to dissipate the thermal energy that arises in the production of the X-rays.

In an operating mode known as a single-pole operating mode, as shown in FIG. 1, the anode 9, which is electrically insulated from the cathode 5, is at ground potential. In two-pole operation, the anode 9 is at a positive potential relative to the cathode 5. An electrical field thus arises between the cathode 5 and the anode 8, due to the tube voltage across these components, this field serving to accelerate the electrons emitted by the cathode 5 in the direction toward the anode 9.

The vacuum housing 2 and the anode 9 are constructed so as to be substantially rotationally symmetrical in relation to a center 13. The vacuum housing 2 with the cathode 5, together with the focusing electrode 7 and the anode 9, is mounted in the protective housing (not shown in FIG. 1) so as to be able to be rotated about the center 13, by means of bearing elements 14, 15. Suitable drive means (not shown in FIG. 1) are provided in order to set the arrangement into rotation in the operation of the X-ray source 1.

In its cylindrical region 3, the vacuum housing 2 is surrounded by a magnet system 16 that is fastened in the protective housing (not shown in FIG. 1). The magnet system 16 accordingly does not rotate with the vacuum housing 2 during operation. The magnet system 16 is supplied with electrical signals, i.e. currents and/or voltages, by an arrangement for setting the size of the X-ray focal spot FS, namely a supply unit 19. These currents/voltages serve to produce a dipole field as well as to produce a quadrupole field superimposed on this dipole field.

The quadrupole field serves to focus the electron beam 8. Such focusing is set by means of an adjusting element 20 of the supply unit 19. The adjusting element 20 causes modification of the field strength of the quadrupole field. The width, extending in the tangential direction of the anode 9 and the anode edge 11, of the X-ray focal spot FS can be set to a desired size by this field strength modification. As a result of the quadrupole field, the initially circular cross-section of electron beam 8 is changed.

The dipole field serves to deflect the electron beam 8 in such a way that the X-ray focal spot FS arises at the desired location on the anode edge 11. For this purpose, the dipole field has a constant field component.

The dipole field serves additionally to deflect the electron beam 8 in the radial direction of the anode 9 and the anode edge 11 so that the striking location of the electron beam 8 is periodically displaced on the anode edge 11 by an amount (distance) predetermined by the constant field component of the dipole field. This distance is such that the effective length—measured in the radial direction of the anode 9 and the anode edge 11, and thus in the direction of the deflection—of the X-ray focal spot FS arising as a result of the deflection is in a desired ratio to the aforementioned focal spot width. This ratio is another adjusting element 21 of the supply unit 19. The scale allocated to the adjustment element 21 shows the values for the ratio of length to width as seen in a direction opposite to the direction of propagation of the X-rays.

In order to effect this periodic deflection, a wobble signal is superimposed on the signal that is supplied to the magnet system 16 by the supply unit 19 in order to produce the constant component of the dipole field. This superimposition produces a periodically changing component of the dipole field, this component serving for the periodic deflection of the electron beam 8. The amplitude of the wobble signal, and thus the distance of the displacement of the X-ray focal spot FS, is the actual parameter which is modified when a particular ratio is set by the adjustment element 21 of the supply unit 19.

Preferably, a ratio of effective length to width of the X-ray focal spot FS is set such that, seen opposite the primary direction of propagation (designated 17 in FIG. 1) of the X-rays emanating from the anode edge 11, the ratio of resulting length to width of the X-ray focal spot FS is equal to one, i.e., the ratio of effective length to width of the X-ray focal spot FS corresponds to the scale ratio of the oblique anode edge 11.

In the following, as an example the manner of functioning of the X-ray source according to FIG. 1 is explained on the basis of FIGS. 2*a* to 3*d*.

If the smallest possible size of the X-ray spot FS, having a width of e.g. 0.5 mm, is to be set, given a ratio of length to width of one as seen opposite the direction of propagation of the X-rays (the situation in FIGS. 2*a*, 2*b* and 2*c*), the adjusting element 20 is set to its left stop (extreme) and the adjusting element 21 is set to the value 1. The magnet system 16 is then driven by the supply unit 19 for the production of a quadrupole field such that the cross-section of the electron beam 8 (which in the absence of this quadrupole field would for example, as illustrated in FIG. 2*a*, have a width of approximately 0.75 mm at its striking location on the anode edge 11) is deformed in the tangential direction by interaction with the quadrupole field so that the cross-section of the electron beam 8, as shown in FIG. 2*b*, has a width of only 0.5 mm at its striking location on the anode edge 11. The cross-section of the electron beam 8 is thereby simultaneously elongated in the radial direction by interaction with the quadrupole field, so that the cross-section of the electron beam 8, as shown in FIG. 2*b* its striking location on the anode edge 11 now has a length of, for example, 4 mm. The ratio of length to width of the X-ray focal spot FS thus results as 4 mm: 0.5 mm=8.

Given an angle between the primary direction of propagation 17 of the X-rays and the beveled anode edge 11, which in the specified embodiment is 8°, the X-ray focal spot FS', as seen opposite the primary direction of propagation 17 of the X-rays, thus has a width of approximately 0.5 mm and a length of approximately 0.56 mm. The ratio of effective length to width, as seen opposite the primary direction of propagation 17 of the X-rays, thus results as 0.56 mm: 0.5 mm=1.12. It thus has approximately the value one, so that the X-ray focal spot FS, as seen opposite the primary direction of propagation 17 of the X-ray radiation, has an essentially circular shape as shown in FIG. 2*c*.

In order to produce a larger X-ray focal spot FS with a width of approximately 1 mm, the adjustment element 20 is set to a position to cause the supply unit 19 to drive the magnet system 16 in order to produce a quadrupole field such that the cross-section of the electron beam 8 (which in the absence of this quadrupole field would for example, as illustrated in FIG. 3*a*, again have a width of approximately 0.75 mm at its striking location on the anode edge 11) is deformed in the tangential direction by interaction with the quadrupole field so that the cross-section of the electron beam 8 at its striking location on the anode edge II now has a width of 1.0 mm, as shown in FIG. 3*b*. The cross-section of the electron beam 8 is thereby again elongated in the radial direction by interaction with the quadrupole field, but as a result of the modified quadrupole field this now occurs in such a way that the cross-section of the electron beam 8, as shown in FIG. 3*b*, now has a length of only 3.3 mm at its striking location on the anode edge 11.

Since the length of the electron beam 8 at its striking location on the anode edge 11 is thus too small to produce an X-ray focal spot FS in which the length and width are substantially equal as seen opposite the primary direction of propagation 17 of the X-rays, the supply unit 19 additionally drives the magnet system 16 with a wobble signal which causes the dipole field to change periodically so that a periodic deflection of the electron beam 8 takes place in the radial direction, i.e. in the direction of the needed extension of the length of the X-ray focal spot FS. This deflection takes place with an amplitude so that, as a result of the deflection, an X-ray focal spot FS arises whose length resulting from the deflection is dimensioned such that a ratio of effective length to width of the X-ray focal spot FS is present that has, as in the case of the smallest possible X-ray focal spot FS, the value 8. This means that the effective length of the X-ray focal spot FS has to be 8 mm, and the distance d by which deflection has to take place has to be 8 mm−3.3 mm=4.7 mm=d. As shown in FIG. 3*c*, an X-ray focal spot FS is then produced that, given the angle of 8° between the primary direction of radiation 17 of the X-rays and the anode edge 11, appears as a circular X-ray focal spot FS', as seen opposite the primary direction of propagation 17 of the X-rays, and which has a ratio of effective length to width, also as seen opposite the primary direction of propagation of the X-rays, that approximates the value 1 set by means of the adjusting element 21.

Data are stored in the supply unit 19 that correspond to the signals to be supplied for driving the magnet system 16 for the production of the quadrupole field, the constant field portion of the dipole field, and the periodically changing field portion of the dipole field, dependent on the size, set by the adjustment element 20, of the X-ray focal spot FS, and on the ratio, set by the adjustment element 21, of resulting length to width of the X-ray focal spot FS, so that the supply unit 19 supplies the magnet system 16 with the signals corresponding to the settings of the adjusting elements 20 and 21.

If setting elements (not shown in FIG. 1) are provided for the tube current and/or the tube voltage, the aforementioned data are also stored as a function of tube current and/or the tube voltage.

Given X-ray focal spots produced by deflection of the electron beam 8, as in the prior art a Gauss distribution of the intensity of the X-ray radiation is present in the direction of the width of the X-ray focal spot FS, i.e. in the radial direction of the anode 9 and the anode edge 11. The intensity distribution of the X-ray radiation in the direction of the length of the X-ray focal spot FS, i.e. in the radial direction of the anode 9, however, depends on the chronological curve of the wobble signal. If, as in the specified embodiment, this corresponds essentially to a sawtooth function, designated 18 in FIG. 4, the intensity distribution of the X-ray radiation in the direction of the length of the X-ray focal spot FS is, as can be seen from FIG. 4, approximately rectangular. Such an intensity distribution yields advantages both with respect to the achievable imaging quality and distribution of the thermal loading of the anode 9, and the latter contributing to a larger useful life of the anode 9.

Figure 4:
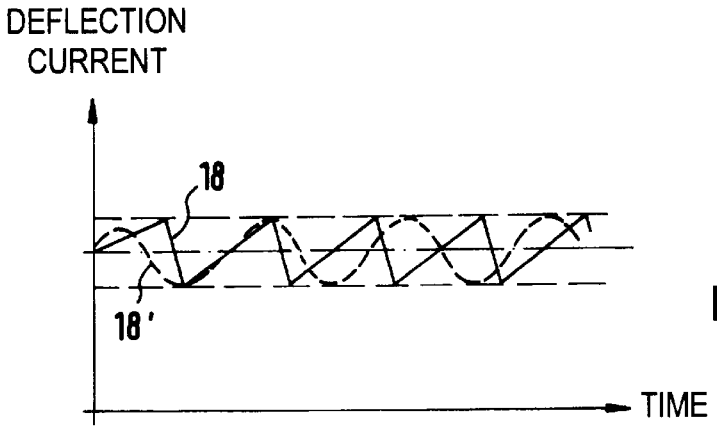
FIG. 4 shows the signal supplied to the magnet system of the X-ray source of FIG. 1 for producing a dipole field with a wobble signal superimposed thereon.

Instead of a sawtooth-shaped wobble signal 18, other chronological curves of the wobble signal can be provided according dependent on particular applications, e.g. the sinusoidal curve 18' shown in broken lines in FIG. 4.

The above-specified inventive X-ray source offers, in particular, the following advantages. A lower technological outlay is required, since only one electron emitter is necessary. The X-ray source has easily achievable retrofitting compatibility, i.e., an inventive X-ray source can be used in existing installations, since, in contrast to the prior art, no additional adjustable focusing voltage is required. Only one heating characteristic is required for all sizes of the X-ray focal spot; for the larger X-ray focal spots a tube (bulb) piston temperature results that is lower than in the prior art. In order to modify existing conventional rotating bulb sources so as to correspond to the invention, it is only necessary to slightly modify the drive of the magnet system, since the single change required for the realization of the invention is the superimposition of a wobble signal and a different setting of the quadrupole field. Rotating bulb sources thus can be modified easily or improved in this way, which can be advantageous for the modular construction of a group of sources. Lastly, the inventive construction can be realized at low cost.

The electron emitter is designed so that both the smallest desired size of the X-ray focal spot, as well as the required maximum tube current, can be realized. In addition, it should be noted that given small sizes of the X-ray focal spot, slightly higher bulb temperatures can occur than in the prior art.

In the production of the smallest possible X-ray focal spot, in the specified embodiment no wobble signal is supplied to the magnet system 16, since a desired ratio of length to width is already achieved without this wobble signal. This does not mean, however, that a wobble signal cannot also be employed for the production of the smallest possible X-ray focal spot.

In the embodiment specified above, a rotating bulb source is provided as an X-ray source. The invention can also be used in differently constructed X-ray sources, e.g. in a rotating-anode X-ray source according to U.S. Pat. No. 5,812,632, or in fixed-anode X-ray sources.

The size of the focal spot and the ratio of length to width of the X-ray focal spot can be adjusted continuously in the specified embodiment. It is also possible within the scope of the invention to provide several switchable sizes of focal spots, with a fixed ratio of length to width of each X-ray focal spot.

In the specified embodiment, the electron beam 8 emanating from the electron emitter 5 has a circular cross-section. The invention can also be used in connection with X-ray sources whose electron emitters produce electron beams that have a cross-section that deviates from a circular shape.

The oblique positioning, provided in the specified embodiment, of the region of the anode in which the X-ray focal spot is located, relative to the primary direction of propagation of the X-rays, need not necessarily be present within the scope of the invention.

Although modifications and changes may be suggested by those skilled in the art, it is the intention of the inventors to embody within the patent warranted hereon all changes and modifications as reasonably and properly come within the scope of their contribution to the art.

We claim as our invention:

1. An X-ray source comprising:

an evacuated housing;

an anode disposed in said housing;

a cathode disposed in said housing which emits an electron beam which proceeds along a beam path in said housing to strike said anode in a focal spot, having a size defined by a length and a width, on said anode from which X-rays are emitted;

a magnet system which produces a dipole field and a quadrupole field superimposed on said dipole field, said beam path proceeding through said dipole field and said quadrupole field, for deflecting and focusing said electron beam; and said magnet system including a control unit for selectively adjusting the size of said focal spot on said anode so that said focal spot has a ratio of said length to said width, said control unit adjusting said quadrupole field to set said width of said focal spot and producing a wobble signal to modify said dipole field to periodically displace said electron beam on said anode in a direction transverse to said width by a distance to give said focal spot an effective length relative to said width to produce said ratio.

2. An X-ray source as claimed in claim 1 wherein said control unit includes an adjustment element which can be adjusted to select said ratio.

3. An X-ray source as claimed in claim 1 wherein said ratio is substantially equal to one, as seen from a direction opposite to a primary propagation direction of said x-rays emitted from said focal spot.

4. An X-ray source as claimed in claim 1 wherein said cathode comprises a cathode which emits said electron beam with a substantially circular cross-section.

5. An X-ray source as claimed in claim 1 wherein said anode comprises a rotating anode having an anode edge which is beveled relative to a primary direction of propagation of said X-rays, said focal spot being disposed on said anode edge, and wherein said width of said focal spot proceeds in a tangential direction of said anode and wherein said effective length of said focal spot proceeds in a radial direction of said anode.

6. An X-ray source as claimed in claim 5 wherein said control unit comprises an adjustment element for selectively setting said ratio.

7. An X-ray source as claimed in claim 5 wherein said ratio is substantially equal to one, as seen from a direction opposite to a primary propagation direction of said x-rays emitted from said focal spot.

8. An X-ray source as claimed in claim 5 wherein said cathode comprises a cathode which emits said electron beam with a substantially circular cross-section.

9. An X-ray source as claimed in claim 5 wherein said evacuated housing comprises a rotating bulb with said anode attached to said rotating bulb.

10. An X-ray source as claimed in claim 9 wherein said cathode is rigidly connected to said rotating bulb, and wherein said magnet system surrounds said rotating bulb.

11. An X-ray source as claimed in claim 1 wherein said control unit produces said wobble signal with a chronological curve for producing an intensity distribution of said X-rays at said focal spot along a radial direction of said anode having a predetermined shape deviating from a Gaussian distribution.

12. An X-ray source as claimed in claim 11 wherein said wobble signal has a chronological curve comprising a sawtooth curve.

13. A method for operating an X-ray source comprising the steps of:

emitting an electron beam along a beam path from a cathode;

producing a dipole field with a quadrupole field superimposed thereon with a magnet system and interacting said electron beam with said dipole field and said quadrupole field to focus and deflect said electron beam onto a focal spot on an anode to cause X-rays to be emitted from said anode; and modifying said dipole field with a wobble signal to periodically displace said electron beam on said anode in a direction transverse to said width by a distance to give said focal spot an effective length relative to said width to produce a predetermined ratio of said effective length to said width.

14. A method as claimed in claim 13 comprising selecting said ratio from among a plurality of settable ratios.

15. A method as claimed in claim 13 wherein the step of modifying said dipole field with a wobble signal comprises modifying said dipole field with a wobble signal having a sawtooth curve.

* * * * *